United States Patent [19]

Boxall et al.

[11] 4,428,847

[45] Jan. 31, 1984

[54] ANODE STUD COATINGS FOR ELECTROLYTIC CELLS

[75] Inventors: Larry G. Boxall; Dennis C. Nagle, both of Baltimore, Md.

[73] Assignee: Martin Marietta Corporation, Bethesda, Md.

[21] Appl. No.: 406,753

[22] Filed: Aug. 10, 1982

Related U.S. Application Data

[62] Division of Ser. No. 225,066, Jan. 14, 1981, Pat. No. 4,354,918.

[51] Int. Cl.[3] ..... C25B 11/04; C25B 11/12

[52] U.S. Cl. ..... 502/101; 204/290 R; 204/294

[58] Field of Search ..... 252/425.3; 204/294, 204/290 R, 67

[56] References Cited

U.S. PATENT DOCUMENTS

| | | | |
|---|---|---|---|
| 3,156,639 | 11/1964 | Kibby | 204/243 R |
| 3,274,093 | 9/1966 | McMinn | 204/243 R |
| 3,632,498 | 1/1972 | Beer | 204/290 F |
| 3,770,613 | 11/1973 | Chisholm | 204/290 R |

*Primary Examiner*—F. Edmundson

*Attorney, Agent, or Firm*—Gay Chin; Herbert W. Mylius

[57] ABSTRACT

The invention relates to a method for protecting anode studs by coating the anode studs with an outermost surface layer of titanium diboride, zirconium diboride, titanium carbide, zirconium carbide, or mixtures thereof. The anode studs which are specifically to be protected in this instance are anode studs for electrolytic cells for the production of aluminum. The steel anode stud is conventionally subject to high corrosion rates due to the atmosphere in the aluminum furnace, and the industry has long sought means to protect this stud from corrosion without inhibiting electrical conductivity, while providing high temperature resistance to oxidation, and thermal shock resistance. It is also necessary that any coating applied to the steel anode stud be compatible with the carbon mass which is utilized as the anode per se. In accordance with the present invention, coatings of titanium diboride, zirconium diboride, titanium carbide, zirconium carbide, and mixtures thereof, have been found effective. It has also been found that the presence of up to ten percent by weight of molybdenum disilicide is advantageous, and that a subcoating of stainless steel reduces thermal stresses and improves bonding.

6 Claims, No Drawings

ANODE STUD COATINGS FOR ELECTROLYTIC CELLS

This application is a division of application Ser. No. 225,066, filed Jan. 14, 1981 now U.S. Pat. No. 4,354,918, issued Oct. 19, 1982.

BACKGROUND OF THE INVENTION

This invention relates to anodes for electrolytic cells for the production of aluminum, and specifically to a method to reduce anode stud corrosion which will result in a reduction in anode voltage losses, labor required to reset anode studs and stud maintenance costs and an improvement in anode and cell performance.

A commonly utilized electrolytic cell for the manufacture of aluminum is of the classic Hall-Heroult design, utilizing carbon anodes and a substantially flat carbon-lined bottom which functions as part of the cathodic system. The electrolyte used in the production of aluminum by electrolytic reduction of alumina consists primarily of molten cryolite with dissolved alumina, and may contain other material such as fluorspar, aluminum fluoride, and other metal fluoride salts. Molten aluminum resulting from the reduction of alumina is most frequently permitted to accumulate in the bottom of the receptacle forming the electrolytic cell, as a molten metal pad or pool over the carbon-lined bottom, thus acting as a liquid metal cathode. Carbon anodes extending into the receptacle from above, and contacting the molten electrolyte, are adjusted relative to the liquid metal cathode. Clark collector bars, frequently of steel, are often embedded in the carbon-lined cell bottom, completing the connection to the cathodic system. Similarly the commonly utilized carbon anodes are physically and electrically connected to anode studs, most often of steel, which are suitably raised and lowered as necessitated by the oxidization of the carbon anode and the necessary renewal thereof.

The electrolyte contained in the electrolytic cell forms a solid crust where exposed to the cooler atmosphere above the electrolyte, which in turn is covered with a layer of alumina for periodical enrichment of the electrolyte and thermal insulation of the bath in the electrolyte pot. The anodes, consisting of carbon, penetrate the alumina layer and the crust, extending into the electrolyte, for conduction of the electric current which maintains the electrolysis. The crust, and the aluminum oxide deposited thereon, normally do not form a gas-type seal around the circumference of each anode, due to rising gases and motion of the molten electrolyte. In addition, the crust is periodically broken for enrichment of the electrolyte with alumina.

The gases released from the electrolytic process, primarily a mixture of gaseous fluorides, carbon dioxide, $CO_2$, and carbon monoxide, CO, penetrate the carbon anode through cracks and open porosity within the carbon anode. These gases can react with chemical components within the anode to form a corrosive gas such as $CO+S=COS$, carbonyl sulfide. The anode gas and/or gaseous products are corrosive to the anode studs supporting the carbon anodes and providing electrical connection thereto. The temperatures within the anode can range from 100° C. or greater at the top of the anode to the temperature of the electrolyte 900° to 1000° C. at anode lower surface. Thus the anode stud, normally an unprotected steel surface, is subjected to highly corrosive gases at temperatures which expedite corrosion and deterioration of such materials.

Although considerable effort has been expended to protect other components of the electrolytic cell, such as the electrodes themselves, we are not aware of any satisfactory method to reduce anode stud corrosion. It is known that corrosion of the anode studs in a vertical stud Soderberg aluminum reduction cell contributes directly to increased stud maintenance cost and power consumption, as well as reduced metal quality and cell performance. The anode studs corrode, forming a scale containing various forms of iron sulfide and iron carbide. It has been shown that one corrosive agent involved is carbonyl sulfide, COS, which forms in a reaction between CO and the sulfur in the anode carbonaceous materials. During stud pulling, i.e., removal of the stud for resetting to a greater distance from the anode face, pieces of the scale remain in the anode, which in time are transferred qualitatively into the metal. It has also been observed that the iron content in the aluminum metal produced was a direct function of the sulfur content of the anode materials in Soderberg cell operation. It has previously been reported that low alloy steels corrode significantly less than ordinary carbon steels when exposed to a sulfur-bearing anode mass, although later results disputed this reported improvement. A steel stud coated with aluminum appears to be protected from attack by a fluoride-free sulfur-bearing anode mass. However, with the introduction of amounts of volatile fluoride, known to be present in actual anode gases, such aluminum coating and stud material were heavily corroded.

Formation of a poor electrically conducting iron sulfide film on an anode stud increases the cell voltage loss in the anode and consequently increases the energy required to produce aluminum. The increased stud to carbon contact resistance produces local non-uniformity in the anode current distribution, which can initiate and/or enhance the formation of anode spikes, which can short-circuit through the metal pad causing severe local heating within the anode. Thus, it is desirable to prevent the formation of this scale or film. It is noted that such short-circuiting can result in the melting of several inches of iron from the stud tip, and the formation of small metal globules of iron in the anode carbon.

Development of a cost-effective, corrosion-resistant, electric-conductive stud coating would clearly help to reduce cell energy requirements, improve metal quality, and permit the use of low-cost, high sulfur-content anode carbonaceous materials. In addition, anode stud maintenance would be reduced, consequently simplifying the stud resetting process, hence further reducing operating costs.

SUMMARY OF THE INVENTION

It is an object of the present invention to provide a corrosion-resistant coating on the steel anode stud, which coating is electrically conductive and resistant to high temperature air oxidation and thermal shock. It is a further object of the present invention to provide a method for application of a protective coating to anode studs and other metal components of an electrolytic reduction cell. Such coatings help reduce the energy requirement for producing aluminum metal, reduce anode stud maintenance costs, reduce iron contamination in the aluminum metal, and maintain a more uniform anode current distribution, which could lead to improved cell current efficiency and simplify the stud resetting process.

These and other objects of the invention are attained by application to the steel anode studs of a coating comprising titanium diboride ($TiB_2$) and/or similar materials, such as zirconium diboride, titanium carbide and zirconium carbide. Additives may be used to produce other desired coating qualities, such as molybdenum disilicide to improve resistance to thermal oxidation. Sintering aids such as rhodium or iridium may be used to help reduce the porosity and improve the strength of the coating.

DESCRIPTION OF PREFERRED EMBODIMENTS

The present invention relates specifically to the application of a corrosion-resistant coating to a VSS cell anode stud. However, this concept may also be applied to the studs of a horizontal anode stud cell, the metal holders of prebaked anodes, and other metal cell parts subject to corrosion. A suitable corrosion resistant coating has potential application wherever corrosion occurs and/or improved electrical contact is desired.

Conventionally, the anode studs utilized in a VSS cell comprise a low carbon steel material. It has been found, by experimentation, that when a corrosion resistant coating is applied to a conventional steel anode stud, improved results are obtained when a stainless steel sub-coating is also used. This prior coating reduces thermal stresses and improves the bonding between the corrosion-resistant coating and the base metal. The stainless steel sub-coat may be applied in any conventional manner, such as by plasma spray, vapor deposition, electric arc, flame spray, etc. Suitable other materials for utilization as the sub-coat or bond coat include chromium based alloys, such as chromel, nickel containing stainless steel, such as Inconel, and other alloys which tend to reduce thermal stresses and improve the bonding between the outer coatings and the stud substrate.

It has been found that the corrosion resistant coating may be effectively utilized over the entire stud, or over the lower-most portion of the stud. Further, thickness of the corrosion-resistant coating material may be varied from 2 mils to approximately 100 mils. However, it is noted that a non-porous or impervious coating is most desirable. It is also noted that the coating may have a homogeneous composition and density, or have a controlled composition with a density gradient from outermost surface to the portion in contact with the bond coating.

Suitable coating materials have been found to be titantium diboride, zirconium diboride, titantium diboride-molybdenum disilicide, and zirconium diboride-molybdenum disilicide. Other materials found useful include titantium carbide, zirconium carbide, molybdenum disilicide, and mixtures of these materials with any of the metal oxides associated with non-consummable anodes in the patent literature. The top protective coating may be applied in any conventional manner, such as by plasma spray, vapor deposition, electric arc, flame spray, etc.

It has been found that mixture of $TiB_2+MoSi_2$ is the preferred coating material of the materials listed when applied using a plasma spray process.

Example I-Bond Coat Composition

Chemical corrosion tests were conducted to determine which of the potential bond coats exhibited the best resistance to corrosion by sulfur at elevated temperatures. The sulfur corrosion resistance of the bond coat is not critical to the success of the coating system; however, it is desirable for the bond coat to be corrosion resistant in case the top coat has or develops defects. The following illustrates that corrosion of 309 stainless steel is significantly less than other metals tested when baked for 150 hours at 1000° C. in anode paste.

| Metal | wt % Cr | wt % Ni | mils corroded |
|---|---|---|---|
| Carbon steel | 0 | 0 | 25 |
| Nitrom 60 | 18 | 8 | 25 |
| 333 B stainless steel | 44 | 24 | 27 |
| 330 stainless steel | 34 | 23 | 22 |
| 309 stainless steel | 25 | 12 | <1 |

Example II-Typical Plasma Spray Coating Procedure

A 309 stainless bond coat and $TiB_2$, $ZrB_2$, and $TiB_2$. $MoSi_2$ top coats were applied to ¼ in., ½ in. and 1 in. diameter low carbon steel test rods and tapered 4–5 in. diameter steel VSS stud tips, using a plasma spray process. The coated test rods were used for laboratory tests while the coated stud tips were used for a pilot test using production VSS aluminum reduction cells (100K amp line current). A micrometer was used to determine coating thickness.

Sample preparation consisted of degreasing with methyl-ethyl-ketone followed by grit blasting with 54 mesh grit ($Al_2O_3$).

The 309 stainless steel bond coat was applied utilizing a plasma spray technique employing 400–800 amps with an argon plus 5 volume % $H_2$ plasma gas, utilizing 309 stainless steel, −200 to +325 mesh, to achieve the desired coating thickness, typically 2–10 mils, preferably 8–10 mils. The substrate was preheated to 150° C. and the spray rate and cooling air/inert gas flow were adjusted such that a substrate temperature of 95°–370° C. was maintained, with a 95°–150° C. range preferred. Bond strength tests were used to help select the preferred operating parameters.

The operational parameters for the corrosion-resistant top coat, such as $TiB_2$, involve the use of an argon plus 5 volume % $H_2$ plasma gas operating at 400–800 amps utilizing an appropriate spray rate and air/inert gas cooling to maintain a sample temperature in the range 95° C. to 370° C., with a preferred sample temperature less than 200° C. Successful coatings of each of the corrosion resistant materials over the bond coating was achieved. Preferred coating thickness is about 10 mils although a range of from about 2 to 20 mils is acceptable.

Example III-Carbon to $TiB_2$ Contact Resistance

A hot-pressed bar of titantium diboride, ½" square, was baked for 24 hours at 875° C. in anode paste, a mixture of coke and pitch obtained from the Martin Marietta VSS Aluminum Reduction Plant located at The Dalles, Oreg. Small pieces of baked anode carbon remained attached to the $TiB_2$ when the baked sample was broken apart. The resistance of a carbon to $TiB_2$ to carbon section of the test sample was compared to that for an equal length and cross section of pure anode carbon. The resistance for both measurements were 0.1+0.1 ohms. Accordingly, there is qualitatively no measurable contact resistance between the hot-pressed $TiB_2$ and baked anode carbon.

Example IV-$TiB_2$/Stainless Steel/Substrate Resistance

A titanium diboride coating over stainless steel on a steel substrate was subjected to contact resistance measurement. The resistance of the steel rod was measured utilizing the same procedure, absent the coating materials. The difference between the measured resistance for the coated and uncoated steel rod was halved to yield total resistance for the coating and associated interfaces. It was found that the typical total measured resistance for a 10 mil $TiB_2$ coating plus a 2 mil stainless steel bond plus the $TiB_2$/stainless steel/substrate steel interfaces is about 4 micro ohms per square centimeter of coating surface area. In a VSS anode, the current density through the stud coating would approximate 1 amp per $cm^2$, resulting in an estimated $4\times10^{-6}$ volt drop across the stud coating. Such a low voltage drop is insignificant compared to the 100 to 300 mV drop across the uncoated stud/carbon interface experienced commercially.

Example V-Thermal Shock Tests

Coated test rods were rapidly cycled between 900° C. and 100° C. to test thermal stress properties of the various coatings. In each cycle, the sample was heated in a 900° C. furnace for 15 minutes in a nitrogen atmosphere, then allowed to cool in air for 10 minutes. With no stainless steel bond coat, the $TiB_2$ coating started to crack after 10 heat cycles. The $TiB_2$ coating with a stainless steel bond coat exhibited no evidence of cracking after 14 heat cycles. The $ZrB_2$ coating, with a stainless steel bond coat, had no cracks after 9 heat cycles. It is to be noted that the small radius of curvature and faster cool-down rate of the test samples makes this thermal stress test more severe than would be experienced in real commercial anode operation. Further, there is a 2–3 week annealing time in a vertical stud anode to help relieve thermal stress, which annealing time is not present in the laboratory test.

Example VI-Corrosion Resistance to Vertical Stud Soderberg Anode Environment

A test reactor was used to simulate the corrosive environment within a VSS anode. The anode environment reactor comprised a tube furnace surrounding a stainless steel reactor tube, into which were placed pitch coke plus 1 wt.% Atmolite ($NaAlF_4$), and carbon, with the coated portion of the test anode submerged in the carbon. Electrical connections were made to a constant current power supply and the tube furnace was thermally insulated. The Atmolite was added to the pitch coke to provide trace amounts of volatile fluoride, which is normally found in anode gases, since Atmolite is the compound which normally vaporizes from a cryolite bath. Carbonyl sulfide (COS) was forced through the system to simulate bath fume penetration of the VSS Anode, at a concentration of about 50 times that found in typical vertical stud anode operational gases. Hence, the laboratory corrosion test represented an accelerated test condition.

Photographs of test rods before and after the 4-hour corrosion test indicate typical scale thickness of the uncoated section of the test rod to be from 100 to 200 mils. X-ray diffraction analysis identified FeS, Fe and S as the major components of the corrosion scale. In each 4-hour corrosion test, the diameter of the corroded steel test rod, not including the scale, was typically reduced by about 50 mils, which represents a 36 wt.% loss of the metal rod, in uncoated sections. However, the coated sections of the test rods showed no increase in diameter following the corrosion tests for rods coated with either $TiB_2$, $ZrB_2$ or $TiB_2$. 10 wt.% $MoSi_2$. In several tests the coated rod was polarized anodically to give a current density through the coating similar to that for a stud in a VSS anode cell (1.0 amp/$cm^2$). The $TiB_2$ coating has a slightly more metallic appearance following the corrosion test with current than following the tests without current. The $ZrB_2$ and $TiB_2$. 10 wt.% $MoSi_2$ coatings were dimensionally unaffected during the corrosion test, although both coatings developed a white-grey surface discoloration, with $ZrB_2$ being more discolored. There was no sign of spalling or cracking of the coatings as a result of the corrosion test.

Example VII-Coating Resistance Following Corrosion Tests

Qualitative coating resistance measurements were made before and after corrosion tests to determine if the test had significantly changed the coating's electrical properties. The relative measurement for each coating was made by clipping two clip leads of a digital ohmmeter 1" apart on the coated section of the test rod. Prior to the corrosion test, the observed resistace for the $TiB_2$, $ZrB_2$, and $TiB_2$. 10 wt.% $MoSi_2$ coatings were 0.5+0.1 ohms. The $TiB_2$ and $TiB_2$. 10 wt.% $MoSi_2$ coatings showed no increase in resistance following the 4-hour corrosion tests. However, the $ZrB_2$ coating resistance increased by a factor of 20 to 50. The resistance of a $TiB_2$ coating which had been partially oxidized prior to the corrosion test dropped from around 2,000 ohms to 0.8 ohms following a 2.5-hour corrosion test.

Example VIII-Surface Oxidation Test

A simulated cool-down of the stud tip after pulling was achieved by the controlled removal of the test sample from a vertical tube furnace. For each controlled cool-down cycle, the sample was first held at 900° C. for 15 minutes in a nitrogen atmosphere, then with air flowing through the furnace, the sample was slowly withdrawn from the furnace such that the sample temperature dropped from 900° C. to 500° C. in 8 minutes, at which point the sample was removed from the furnace and allowed to air-cool for an additional 7 minutes. The oxidation results are illustrated in Table 1. The relative coating resistances were measured as described in Example VII, and the percent increase in resistance is given by the formula:

$$\frac{\text{(observed resistance)} - \text{(initial resistance)}}{\text{(initial resistance)}} \times 100 = \%\ \text{increase}$$

The air oxidation of the $TiB_2$ coating is improved by the addition of $MoSi_2$. However, the $MoSi_2$ addition must be kept to a minimum to avoid a degradation of the coating thermal shock resistance. Tests have indicated that the $MoSi_2$ addition to the $TiB_2$ coating material should be in the 0–10 wt.% range, although higher $MoSi_2$ concentration may be acceptable. The preferred range for the $MoSi_2$ concentration is 5–10 wt.% for preventing air oxidation of the coating.

TABLE 1

STUD COATING: OXIDATION TESTS

| Bond Coat | Top Coat | Number of Cycles | Increase in Coating Resistance | Observations |
|---|---|---|---|---|
| SS | $TiB_2$ | 1 | 270% | Slight white-gray surface discoloration. |
| | | 3 | 1200% | White-gray surface. |
| | | 5 | 3900% | White-gray surface |
| SS | $TiB_2$ + 10% $MoSi_2$ | 1 | 0% | No observed change. |
| | | 4 | 140% | Slight white-grey surface discoloration. |
| | | 6 | 900% | White-grey surface with scattered dark spots of original surface color; change in coating diameter 274 275 mil. |
| | | 8 | 1500% | White-grey surface, no cracks. |

SS = Ancor 309 stainless steel

Example IX-Pilot Test of Coated Stud Tips

The lower 24 in. portion of 10 VSS studs (about 5 in. diameter) were coated with a 309 stainless steel bond coat and a corrosion resistant top coat utilizing a plasma spray process. The 309 stainless steel bond coats ranged from 7 to 9 mils in thickness. The top coats (3 to 5 mils thick) tested were composed of $TiB_2$ plus $MoSi_2$. The $MoSi_2$ content in the top coat ranged from 5 to 10 weight percent. The coated studs were monitored for four consecutive two-week stud cycles in production VSS anodes. Normal potroom procedures were used in setting and pulling the test studs. The studs were not cleaned between each two-week stud cycle. The pilot test data demonstrated the following benefits of coated studs:

1. The coating prevents corrosion of the steel stud in a VSS anode.
2. Where coating flaws existed, there was no undercutting of the good coating.
3. Compared to an average uncoated stud in an equivalent anode location, the average coated stud carried 15–45% more current which indicates that the average electrical resistance in the anode area associated with a coated stud is reduced by 13 to 41%. An average 20% reduction in overall anode resistance is indicated when coated studs are used in the entire anode. For an VSS anode using all coated studs, the average anode voltage drop would be decreased by 0.10 volts which would save approximately 0.16 Kwh per pound of aluminum produced in a typical 100K amp VSS aluminum producing cell.
4. The current variations between coated studs at a given location in different VSS anodes was less than that for corresponding uncoated studs.
5. When pulled, unlike the uncoated studs, the coated studs did not require cleaning to remove scale and other debris before being reset in the anode.
6. A coating life of 4 to 6 months is anticipated before recoating is required.
7. The stud crane operator estimated force required to pull the coated studs was equivalent to that for a normal coated stud.

The examples have illustrated that the corrosion resistance of the materials utilized exceeds that of any coating or monolithic stud material used previously. Plasma spraying these coatings on the tips of the VSS cells anode studs represents a simple, convenient, and economical method to improve stud life and reduce anode voltages, anode current non-uniformities, iron contamination of the metal pad, stud resetting costs and stud maintenance cost. Improved corrosion resistance will permit use of more readily available, lower cost, higher sulfur content carbon materials in a VSS cell anode.

Although the corrosion resistance coating of the present invention have been applied by plasma spray techniques, it is clear to one of ordinary skill in the art that other alternative methods of application would also be acceptable, such as vapor deposition, electro-deposition, flame spraying, chemical deposition, sintering, and conceivably press fitting of a formed sheet material. The area to be coated may range from a few inches of the stud tip to the entire stud, while coating thickness may range from 2 mil to 100 mils. The corrosion resistant material may be composed of titanium diboride, zirconium diboride, titanium carbide, zirconium carbide or any refractory metal boride or carbide or a mixture of these materials. Additives may be added to obtain additional desired coating properties. A bond coat may be required to help bond the outer corrosion resistant coat to the stud.

We claim:

1. A method for the corrosion protection of steel anode studs, which method comprises providing said anode studs with a protective layer of a material selected from the group consisting of titanium diboride, zirconium diboride, titanium carbide, zirconium carbide, and mixtures thereof, prior to application of a carbonaceous anode material to said stud.

2. A method as set forth in claim 1, wherein said outermost surface also contains up to 10 percent by weight molybdenum disilicide.

3. A method as set forth in claim 1, wherein an intermediate layer of stainless steel is provided between the stud and the outermost surface.

4. A method according to claims 1, 2 or 3, wherein said outermost surface comprises a layer from about 2 to 20 mils thick.

5. A method in accordance with claims 1, 2, or 3, wherein said material is titanium diboride.

6. A method according to claims 1, 2, or 3, wherein said material is applied by plasma spraying.

* * * * *